US007178672B2

(12) United States Patent
Arkins

(10) Patent No.: US 7,178,672 B2
(45) Date of Patent: Feb. 20, 2007

(54) ERECT PACKAGE

(75) Inventor: Thomas Daniel Arkins, Ridgefield, CT (US)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 64 days.

(21) Appl. No.: 11/120,891

(22) Filed: May 3, 2005

(65) Prior Publication Data

US 2006/0249427 A1 Nov. 9, 2006

(51) Int. Cl.
*B65D 73/00* (2006.01)

(52) U.S. Cl. ..... 206/494; 206/210; 206/812

(58) Field of Classification Search ..... 206/205, 206/210, 449, 494, 440, 466, 459.5, 762, 206/812; 220/359.1–359.5
See application file for complete search history.

(56) References Cited

U.S. PATENT DOCUMENTS 3,726,395 A * 4/1973 Duhy ..... 206/449
6,409,077 B1 6/2002 Telesca et al.
6,412,634 B1 7/2002 Telesca et al.
6,520,331 B2 2/2003 Okin et al.
6,648,140 B2 * 11/2003 Petricca ..... 206/356

FOREIGN PATENT DOCUMENTS

JP 405051062 A * 3/1993

* cited by examiner

*Primary Examiner*—Luan K. Bui
(74) *Attorney, Agent, or Firm*—Milton L. Honig

(57) ABSTRACT

A package is provided with usefulness particularly for dispensing of towelettes. The package is constructed as a unitarily formed tub including a floor panel, a pair of opposite side panels, first and second end panels opposite one another and separating the side panels, the first and second end panels having different curvature one from another. An open mouth is formed opposite the floor panel. An outwardly projecting lip at least partially surrounds the open mouth. A cover is arranged over the open mouth and sealed against the lip. The package is capable of standing erect via support contact between a portion of the second end panel and a section of the lip. Graphics are printed on the cover. The asymmetric arrangement of the end panels and adjacent sections of the lip allow the package to stand erect preferentially on one of the end panels thereby orienting right-side up the graphics of the cover.

10 Claims, 2 Drawing Sheets

ERECT PACKAGE

BACKGROUND OF THE INVENTION

1. Field of the Invention

The invention concerns a substantially rectangular container for dispensing articles such as towelettes, wherein the container can stand longitudinally erect on a shelf propped on an end panel.

2. The Related Art

Store shelves are the frontline for a product to attract consumer attention. Packaging is the heavy artillery in this war. Exotic shapes and colors grab attention. Yet some types of products are only modestly amenable to utilizing these allures.

Chemically impregnated pads, sheets and tissues (collectively defined as towelettes) are constrained to only certain types of outer packaging shapes and dispensing mechanisms. Towelettes usually are sold in stacks of multiple individual units each requiring individual dispensing. Towelettes generally can be utilized for personal hygiene, cosmetic purposes and household cleaning applications. Fluid impregnated wipes require packaging which avoids evaporation of solvents. Dry towelettes impregnated with dry chemical coatings (e.g. surfactant compositions) require exclusion of atmospheric moisture during storage periods. Problems arise where a stack of impregnated towelettes is packed together in a common container. Dispensing of a single item requires resealability of the container to prevent the items from either drying out or absorbing unwanted moisture.

Most commonly, towelettes are placed within a resealable outer pouch, the pouch being a foil wrapper. These foil wrappers recline flat on a shelf. Since they are unable to stand erect, they present only a side panel profile to a shopping consumer. Improved visibility can be provided by stacking the foil wrapped towelettes in a cardboard display box. An illustration of this technique is found in U.S. Pat. No. 6,409,077 (Telesca et al.). The technique suffers defeat once consumers have removed a few of the wrapped products from the display carton; the remaining unsold units now have space to slouch downwardly. This reduces their advertising visibility and accentuates a disheveled appearance.

Rigid and refillable towelette dispensing articles are available in the marketplace. Illustrative are the relatively hard dispensing containers described in U.S. Pat. No. 6,520,331 B2 (Okin et al.) and U.S. Pat. No. 6,412,634 B1 (Telesca et al.). Common to both patented dispensing packages is that one of the two major surfaces of the containers is intended as a support surface for resting on a shelf. This means that only a minor panel of the package has an outward oriented facing on a store shelf. There is a need for a much larger advertising footprint on store shelves. The towelette delivery package not only must have advertising presence but must be of low cost construction and functionally capable of maintaining the wet or dry environmental requirements of the individual towelettes.

SUMMARY OF THE INVENTION

A package is provided which includes:

a unitarily formed tub comprising a floor panel, a pair of opposite side panels rising generally orthogonal from the floor panel, a first and second end panel opposite one another and separating the side panels, the first and second end panels having a different curvature one from another, an open mouth opposite the floor panel, and an outwardly projecting lip at least partially surrounding the open mouth;

a cover element arranged over the open mouth and sealed against the lip; and wherein the package is capable of standing erect via support contact between a portion of the second end panel and the lip.

Polyethylene and polypropylene are the polymers of choice for construction of the tub, although other polymers and copolymers may also be suitable. Particularly preferred are foamed versions of the choice polymers, most especially tub panels partially constructed of foamed flexible polymer.

Tubs of the present invention are of unitary construction. These can be produced by thermoform, blow-molding, injection molding, extrusion or similar processes.

The cover element, which is not unitarily formed with the tub, in a preferred embodiment is a foil adhesively attached or welded to the lip. The foil may be formed as a single or multi layer construction. Suitable but not limiting materials for any of the foil layers include polyethylene, polypropylene, polyvinyl chloride, polyvinyl acetate and polyethylene terephthalate. In some embodiments the cover element may be a combination of foil and snap on-off plastic lid. Multiple foils may also be effective as a cover element.

Advantageously the cover, and particularly in foil format, serves as a tablet upon which advertising, regulatory and brand information can be printed. Thus, the graphics may include listing of weight, chemical ingredients, manufacturer identity, barcode, country of origin, use instructions and brand.

In a preferred aspect of this invention, the graphics printed on the cover element are oriented for facile reading in a direction downward from the first end panel toward the second end panel. When the package is stood erect supported on the portion of the second end panel and the lip, the package will be properly oriented for a consumer to read the graphics. Support of the tub along the first end panel is too precarious; the first end panel and section of lip adjacent thereon are sufficiently rounded to cause instability. By having differences in geometry of the end panels and lips adjacent thereto, the stable end is selected as a foot against the shelf and thereby the graphics are always properly oriented right side up. This avoids the package cover element resting vertically on a shelf in an upside down unreadable orientation.

The second end panel has a section with surface upon which the panel can rest against a store shelf. This section forms an angle between about 5 and about 60° with a shelf surface, preferably an angle between about 10 and about 30°.

The lip of the tub circumscribes the open mouth and is formed with a side edge. A section of the side edge adjacent the first end panel is outwardly rounded. A section of the side edge adjacent the second end panel is either straight or concave. Thus, the first and second end panels have different curvature.

BRIEF DESCRIPTION OF THE DRAWING

Various features and advantages of the present invention will become more apparent from consideration of the following drawing in which.

DETAILED DESCRIPTION

Now there is provided a package standable on a store shelf and which allows graphics to be displayed on a cover facing outwardly toward a consumer. Only one of the two end panels is structured to allow the package to stand erect. Graphics on the cover are thereby automatically oriented right-side-up.

Figure 1:
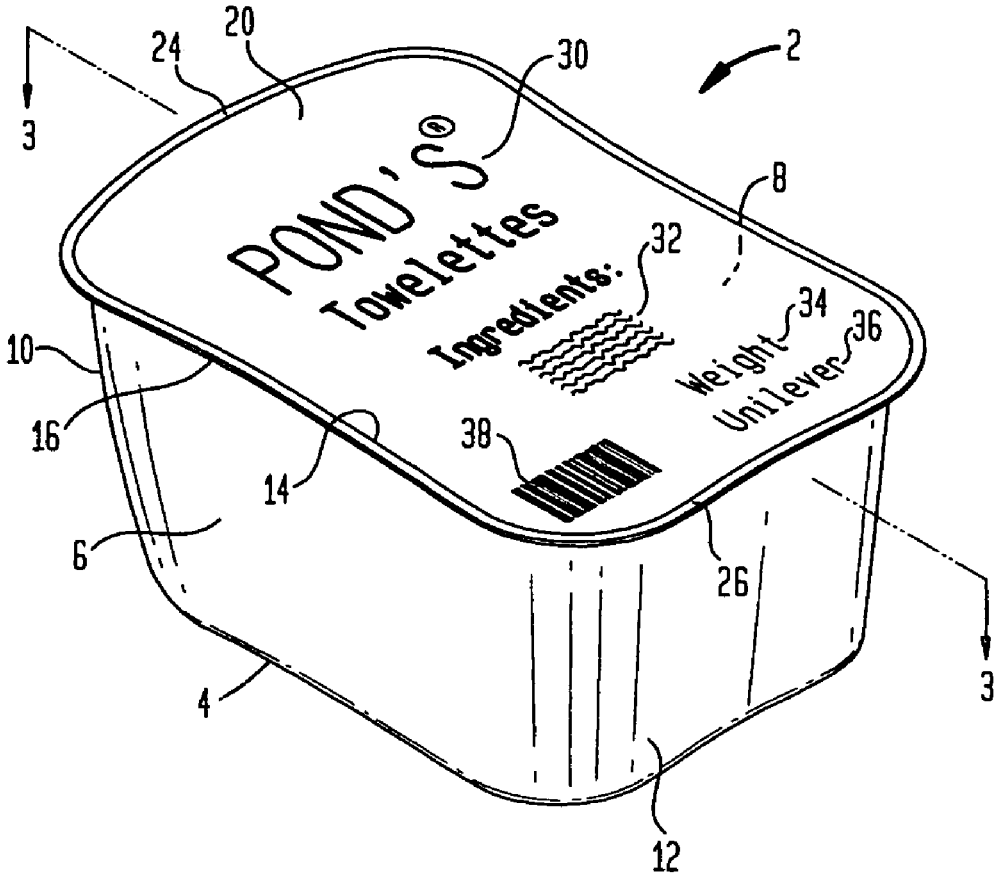
FIG. 1 is a plan perspective view of a package according to the present invention.

A preferred embodiment is illustrated in FIG. 1. A unitarily molded tub 2 is formed by injection molding from polypropylene and/or polyethylene. The tub includes a floor panel 4, a pair of opposite side panels 6, 8 rising generally orthogonal from the floor panel, and first and second end panels 10, 12 opposite one another and separating the side panels. The first and second end panels 10, 12 have a different curvature one from another.

Opposite the floor panel 4 is an open mouth 14 from which articles can be dispensed out of the tub. An outwardly projecting lip 16 surrounds the open mouth.

Figure 2:
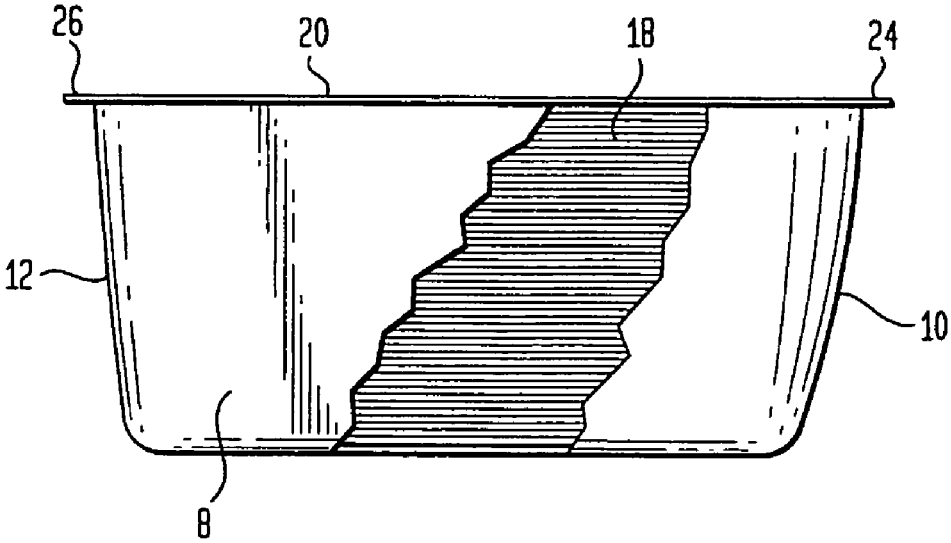
FIG. 2 is a side elevational view of the package according to FIG. 1 partially cut away to reveal a stack of towelettes.

A stack of towelettes 18 fits within a cavity of the tub. FIG. 2 best illustrates the stack of towelettes in a partial cut-away view.

Once filled with towelettes or other articles requiring dispensing, a cover 20 in the form of a thin plastic foil is placed over the open mouth. The cover is adhesively sealed or welded to lip 16.

Figure 3:
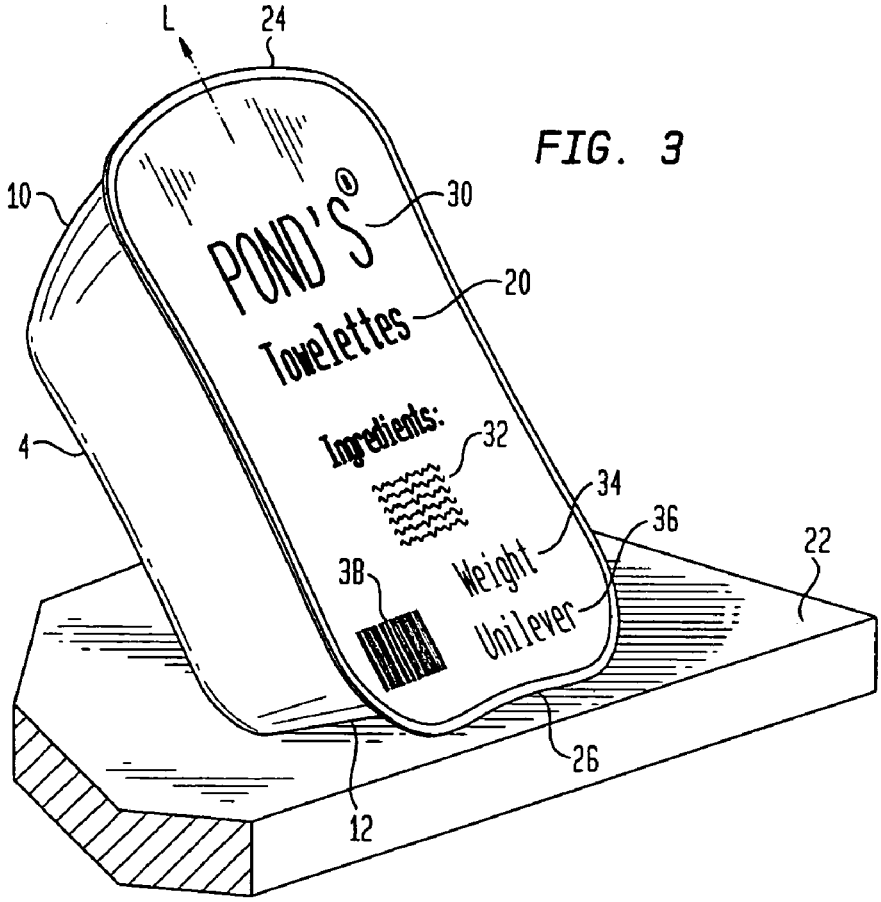
FIG. 3 is a cross-sectional view taken along line 3—3 of the package according to FIG. 1 herein appearing in an erect standing position on a store shelf.

FIG. 3 illustrates the package arranged on a store shelf 22. The package sits in an elongate manner wherein a longitudinal axis L is oriented substantially orthogonal to shelf 22. Thereby cover 20 faces outward toward a store aisle available for viewing by a consumer.

Lip 16 has a first section 24 adjacent first end panel 10. This section 24 features a concave shape. The lip has another portion, which is a second section 26 adjacent the second end panel 12. First and second sections 24, 26 of the lip are shaped differently one from the other. The lip second section 26 features a slightly convex curvature.

Figure 4:
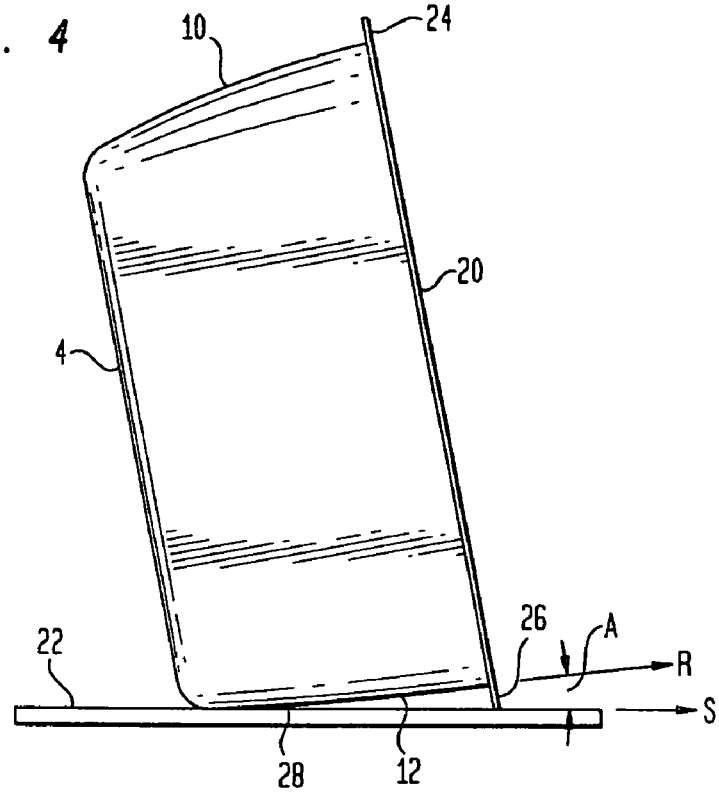
FIG. 4 is a shopping consumer's view of the package according to FIG. 1 standing on a store shelf.

FIG. 4 best illustrates portion 28 of the second end panel 12 interacting with the lip second section 26 to allow the tub to stand erect without tipping over. Portion 28 and shelf 22 at a point of mutual contact form an angle A between the vectors RS. This angle in a preferred embodiment ranges from about 5 to about 60°.

Cover 20 ordinarily is pre-printed with graphics to be read beginning near lip section 24 progressing downward toward lip section 26. Typical graphics include trademarks 30, ingredients 32, weights 34, manufacturer 36 and bar code 38. Although printing is preferred to occur before sealing of the cover across the open mouth, it is also possible to place graphics subsequent to any sealing operation.

The asymmetric arrangement of the end panels 10, 12 and adjacent lip sections 24, 26 insures that only the second panel will serve as a resting foot for the tub on a shelf. The concave curvature of the lip section 24 combined with a more rounded first end panel 10 (relative to the second end panel) causes instability of the tub when the second end panel and respective lip section is utilized as a foot for resting on the shelf. In this manner, the graphics are always oriented properly in a right side up manner. Consumers can thereby always easily read the graphics and readily see this product offering.

Except in the operating and comparative examples, or where otherwise explicitly indicated, all numbers in this description indicating amounts of material ought to be understood as modified by the word "about".

The term "comprising" is meant not to be limiting to any subsequently stated elements but rather to encompass non-specified elements of major or minor functional importance. In other words the listed steps, elements or options need not be exhaustive. Whenever the words "including" or "having" are used, these terms are meant to be equivalent to "comprising" as defined above.

What is claimed is:

1. A package comprising:

a unitarily formed tub comprising a floor panel, a pair of opposite side panels rising generally orthogonal from the floor panel, a first and second end panel opposite one another and separating the side panels, the side panels having a greater surface area than the end panels, the first and second end panels having a different curvature one from another with the first end panel being outwardly convex, an open mouth opposite the floor panel, and an outwardly projecting lip circumscribing the open mouth and formed with a side edge, a section of the side edge adjacent the first end panel being outwardly rounded and another section of the side edge adjacent the second end panel being straight or concave;

a cover element arranged over the open mouth and sealed against the lip, the cover element being in a plane parallel to the floor panel, the cover having graphics printed thereon oriented for reading in a direction downward from the first end panel to the second end panel; and wherein the package is capable of standing erect via support contact between a portion of the second end panel and the lip.

2. The package according to claim 1 wherein the cover is a foil adhesively attached or welded to the lip.

3. The package according to claim 1 wherein the second end panel has a section with surface upon which the panel can rest against a store shelf, the section forming an angle with the shelf of between about 5 and about 60°.

4. The package according to claim 3 wherein the angle is between about 10 and about 30°.

5. The package according to claim 1 wherein the panels are partially constructed of foamed flexible polymer.

6. A towelette product comprising:

(A) a package comprising:

a unitarily formed tub comprising a floor panel, a pair of opposite side panels rising generally orthogonal from the floor panel, a first and second end panel opposite one another and separating the side panels, the side panels having a greater surface area than the end panels, the first and second end panels having a different curvature one from another with the first end panel being outwardly convex, an open mouth opposite the floor panel, and an outwardly projecting lip circumscribing the open mouth and formed with a side edge, a section of the side edge adjacent the first end panel being outwardly rounded and another section of the side edge adjacent the second end panel being straight or concave;

a cover element arranged over the open mouth and sealed against the lip, the cover element being in a plane parallel to the floor panel, the cover having graphics printed thereon oriented for reading in a direction downward from the first end panel to the second end panel; and wherein the package is capable of standing erect via support contact between a portion of the second end panel and the lip;

(B) a stack of towelettes stored within the tub.

7. The towelette product according to claim 6 wherein the cover is a foil adhesively attached or welded to the lip.

8. The towelette product according to claim 6 wherein the second end panel has a section with surface upon which the panel can rest against a store shelf, the section forming an angle with the shelf of between about 5 and about 60°.

9. The towelette product according to claim 8 wherein the angle is between about 10 and about 30°.

10. The towelette product according to claim 6 wherein the panels are partially constructed of foamed flexible polymer.

* * * * *